United States Patent [19]

Keller et al.

[11] 4,181,185

[45] Jan. 1, 1980

[54] THRUST FLANGE ACTUATED ROCK BIT LUBRICATION SYSTEM

[75] Inventors: Wilbur S. Keller, Arlington; William D. Vanderford, Irving, both of Tex.

[73] Assignee: Dresser Industries, Inc., Dallas, Tex.

[21] Appl. No.: 939,312

[22] Filed: Sep. 5, 1978

[51] Int. Cl.[2] ..... E21B 9/08

[52] U.S. Cl. ..... 175/229; 308/8.2

[58] Field of Search ..... 175/229, 228, 337, 372, 175/371; 308/8.2, 107

[56] References Cited

U.S. PATENT DOCUMENTS

| | | | |
|---|---|---|---|
| 959,539 | 5/1910 | Hughes | 175/228 |
| 959,540 | 5/1910 | Hughes | 175/228 |
| 1,010,143 | 11/1911 | Hughes | 175/228 |
| 2,174,102 | 9/1939 | Catland | 175/229 |
| 3,251,634 | 5/1966 | Dareing | 308/8.2 |
| 3,841,422 | 10/1974 | Crow | 175/229 |
| 4,098,358 | 7/1978 | Klima | 175/337 X |

*Primary Examiner*—James A. Leppink
*Assistant Examiner*—Richard E. Favreau
*Attorney, Agent, or Firm*—Eddie E. Scott

[57] ABSTRACT

Lubricant is circulated from a lubricant reservoir to the bearings of a rotary rock bit and back to the lubricant reservoir by a lubricant circulation system that is operated by rotation of the cone cutter upon the bearing pin of the bit. A seal is positioned between the rolling cone cutter and the arm of the bit to maintain lubricant in the bearing area and to prevent fluid in the borehole from entering the bearing area. A lubricant reservoir is located in the bit body. A first passage connects the lubricant reservoir with the bearing area to channel lubricant from the lubricant reservoir to the bearing area. A second passage extends from the bearing area to the lubricant reservoir to allow lubricant to be channeled back to the lubricant reservoir. A groove system in the thrust flange of the cone cutter operates as a viscous or ram pump when rotating against the thrust flange of the bearing pin thereby providing a pumping action to circulate lubricant from the lubricant reservoir through said first passage to the bearing area and from the bearing area through said second passage back to said lubricant reservoir.

1 Claim, 3 Drawing Figures

THRUST FLANGE ACTUATED ROCK BIT LUBRICATION SYSTEM

FIELD OF THE INVENTION

The present invention relates to the art of earth boring and, more particularly, to a rolling cutter earth boring bit with a system for circulating lubricant from a lubricant reservoir to the bearing area and back to the lubricant reservoir. The present invention is especially adapted for use with rock bits popularly known as three-cone rotary rock bits; however, its use is not restricted thereto, and the present invention can be used in other types of rotary rock bits.

BACKGROUND OF THE INVENTION

A three-cone rotary rock bit consists of a main bit body adapted to be connected to a rotary drill string. The bit includes three individual rotatable cone cutters mounted on three individual bearing pins extending from the main bit body. Bearing systems are provided between the cone cutters and the bearing pins to promote rotation of the cutters and means are provided on the outer surface of the cone cutters for disintegrating the earth formations as the bit and the cutters rotate. A supply of undeteriorated lubricant must be maintained proximate the bearing systems throughout the lifetime of the bit. By circulating the lubricant from a reservoir to the bearings and back to the reservoir, the life of the lubricant will be increased and a larger volume of lubricant will be exposed to the bearing surfaces.

A three-cone rotary rock bit must operate under very severe conditions, and the size and geometry of the bit is restricted by the operating characteristics. At the same time, the economics of petroleum production demand a longer lifetime and improved performance from the bit. In attempting to provide an improved bit, new and improved materials have been developed for the cutting structure of the cone cutters. They have provided a longer useful lifetime for the cone cutters. This has resulted in the bearing systems of the bit being often the first to fail during the drilling operation. Consequently, a need exists for new and improved lubrication systems and bearing systems to extend the useful lifetime of the bit and to allow development of other elements that interact with the lubrication and bearing systems. In attempting to provide a new lubrication system, great care must be taken that the overall capacity of the bearing systems is not reduced.

DESCRIPTION OF PRIOR ART

In U.S. Pat. No. 3,244,451 to J. E. Ortloff, patented Apr. 5, 1966, a lubricating system for extending the life of the bearings of a roller cone type bit is shown. Sealing means are provided to effectively separate or close off the clearance between the journal of the leg and the bearings of the roller cone from the exterior of the bit. A special pump means is provided to circulate the lubricating fluid under high pressure through this sealed-off clearance space. The pump means is actuated by the rotation of the roller cone element on the shaft.

In U.S. Pat. No. 3,251,634 to W. D. Dareing, patented May 17, 1966, a lubricating system for extending the life of the bearings of a roller cone type bit is shown. Sealing means are provided to effectively separate or close off the clearance or space between the journal of the leg and the bearings of the roller cone from the exterior of the bit. An electrical pump means is provided to supply a lubricating fluid under high pressure to this sealed-off clearance space.

In U.S. Pat. No. 3,841,422 to M. L. Crow, patented Oct. 15, 1974, a dynamic rock bit lubrication system is shown. Lubricant is circulated from a lubricant reservoir to the bearings of a rotary rock bit and back to the lubricant reservoir by a lubricant circulation system that is operated by movement of the cone cutter upon the bearing pin of the bit. A positive seal is positioned between the rolling cone cutter and the arm of the bit to maintain lubricant in the bearing area and to prevent fluid in the borehole from entering the bearing area. A lubricant reservoir is located in the bit body. A first passage connects the lubricant reservoir with the bearing area to channel lubricant from the lubricant reservoir to the bearing area. A second passage extends from the bearing area to the lubricant reservoir to allow lubricant to be channeled back to the lubricant reservoir. A check valve in at least one of said passages insures one-way flow of lubricant. Axial movement of the cone cutter on the bearing pin provides a pumping action to circulate lubricant from the lubricant reservoir through said first passage to the bearing area and from the bearing area through said second passage back to said lubricant reservoir.

In U.S. Pat. No. 3,844,364 to M. L. Crow, patented Oct. 29, 1974, a hydrostatic rock bit lubrication system is shown. Lubricant is circulated from a lubricant reservoir to the bearings of a rock bit and back to the lubricant reservoir by a lubricant pump that is operated by periodic fluid pressure variations. A pumping chamber is located in the bit body. A movable pumping element is positioned in the pumping chamber. A first side of the pumping element is exposed to the pressure of the drilling fluid. Passages are provided to channel the lubricant from the lubricant reservoir to the bearing systems and back to the lubricant reservoir. The second side of the pumping element is exposed to lubricant in the passages. Check valves in the passages provide one-way flow of lubricant. Periodic pressure variations in the drilling fluid create a reciprocating motion of the pumping element causing the lubricant to be circulated through the passages.

SUMMARY OF THE INVENTION

The present invention provides a lubricant circulation system for a rotary rock bit. Lubricant is circulated from a lubricant reservoir to the bearings of the bit and back to the lubricant reservoir by a lubricant circulation system that is operated by rotation of the rolling cutter upon the bearing pin. A seal is positioned between the rolling cutter and the bearing pin to maintain lubricant in the bearing area and to prevent fluid in the borehole from entering the bearing area. A lubricant reservoir is located in the bit body. A first passage connects the lubricant reservoir with the bearing area to channel lubricant from the lubricant reservoir to the bearing area. A second passage extends from the bearing area to the lubricant reservoir to allow lubricant to be channeled back to the lubricant reservoir. A groove system in the thrust flange of the cone cutter operates as a viscous or ram pump when rotating against the thrust flange of the bearing pin providing a pumping action to circulate lubricant from the lubricant reservoir through said first passage to the bearing area and from the bearing area through said second passage back to said lubricant reservoir. The above and other features and advantages of the present invention will become apparent upon consideration of the following detailed description of the invention when taken in conjunction with the accompanying drawings.

DETAILED DESCRIPTION OF THE INVENTION

Figure 1:
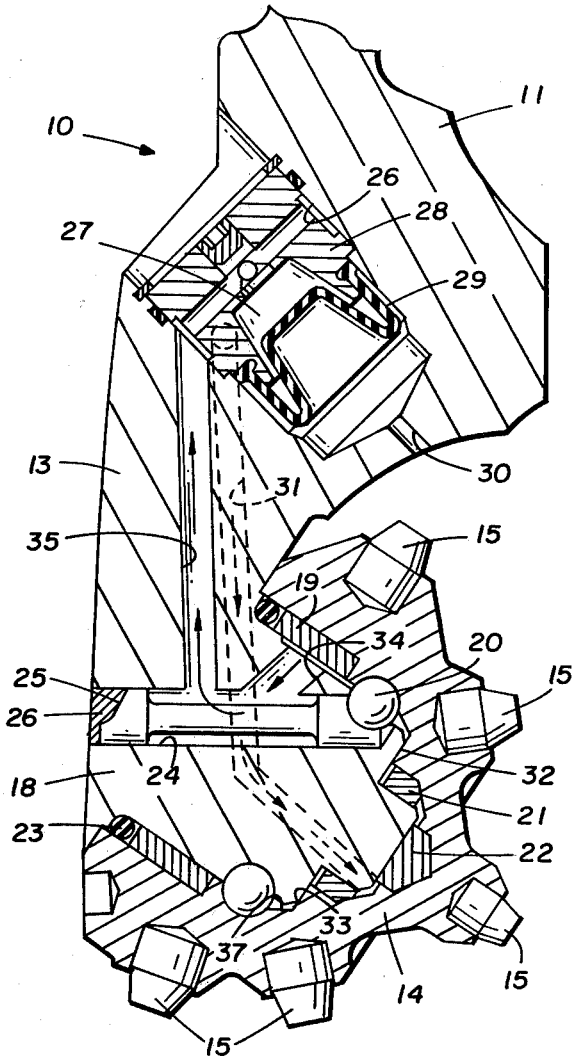
FIG. 1 is a sectional view of one arm of an earth boring bit constructed in accordance with the present invention.

Referring now to FIG. 1, a sectional view of one arm 13 of a three-cone rotary rock bit 10 is shown. It is to be understood that the structures of the other two arms are substantially identical to the arm 13. A cutter 14 is rotatably positioned on the journal portion or bearing pin 18 of the arm 13 and adapted to disintegrate the earth formations as the bit 10 is rotated. The cutting structure 15 on the surface of cutter 14 contacts and disintegrates the formations in a manner that is well known in the art. The cutting structure 15 is shown in the form of tungsten carbide inserts. However, it is to be understood that other cutting structures such as steel teeth may be used as the cutting structure on the cone cutter 14.

The body of the bit 10 includes an upper threaded portion that allows the bit 10 to be connected to the lower end of a rotary drill string (not shown). The bit 10 also includes a central passageway extending along the central axis of the bit to allow drilling fluid to enter from the upper section of the drill string (not shown) immediately above and pass downward to the bottom of the well bore to flush cuttings and drilling debris from the well bore.

A plurality of bearing systems are located in the bearing area between the cutter 14 and the bearing pin 18. The bearing systems in the bearing area include an outer friction bearing 19, a series of ball bearings 20, an inner friction bearing 21, and a thrust button 22. An O-ring seal 23 is positioned between the cutter 14 and the bearing pin 18. This seal retains lubricant in the bearing area around the bearing systems and prevents any materials in the well bore from entering the bearing area. A passageway 24 allows the balls that make up the ball bearing system 20 to be inserted into position after the cone cutter 14 is placed on the bearing pin 18. The series of ball bearings 20 serves to lock the cone cutter 14 on bearing pin 18. After the balls are in place, a plug 25 is inserted into the passageway 24 and welded therein by weld 26. Plug 25 has a reduced diameter throughout the major portion of its length to allow lubricant to flow through the passageway 24.

A cylindrical reservoir chamber 26 is located in the bit body 11. A lubricant reservoir 27 containing a suitable lubricant is positioned in the lubricant reservoir chamber 26. The lubricant reservoir 27 consists of a lubricant reservoir canister 28 with a flexible diaphragm 29 attached. A vent passage 30 allows the pressure of the fluid in the borehole to be transmitted to the outside of the flexible diaphragm 29. A passage 31 extends from the lubricant reservoir 27 to the bearing area between the cutter 14 and the bearing pin 18. A return passage 35 extends from the passage 24 to the lubricant reservoir 27. Lubricant in the bearing area between the cutter 14 and the bearing pin 18 can flow through the passage 24 into the passage 35 back to the lubricant reservoir 27. The opening 34 allows the lubricant to enter passage 24. Lubricant in the lubricant reservoir 27 can flow through the passage 31 to the bearing area.

The present invention provides a system that will circulate the lubricant from the pressure equalizer reservoir 27 to the bearing area. The lubricant in the prior art bearings deteriorates and does not furnish proper lubrication. By circulating the lubricant from the reservoir 27 to the bearing area, the life of the lubricant will be increased by exposing a larger amount of lubricant to the bearing surfaces. The present invention provides a groove system cut in the thrust flange 33 of the cone cutter 14 that operates as a ram or viscous pump when rubbing against the thrust flange 32 of the bearing pin 18. The passage 31 is provided from the reservoir 27 to the pilot pin area and the return passage 35 and 24 is provided from the bearing surface to the reservoir 27. The cone cutter 14 rubbing on the arm flange 32 creates an impedence between the two passages 31 and 35.

Figure 2:
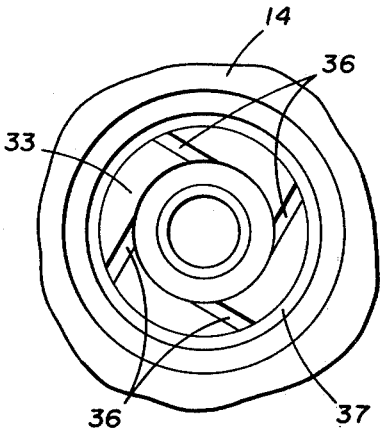
FIG. 2 is a view of the thrust flange of the cone cutter of the bit shown in FIG. 1.

Referring now to FIG. 2, an end view of the cone cutter 14 is provided to illustrate the ram pump or viscous pump action provided by the rotation of the cone cutter 14 upon bearing pin 18. The thrust flange area 33 of the cone cutter 14 includes a series of grooves 36. These grooves provide a pumping action as the cone cutter 14 rotates against the thrust flange 31 of the bearing pin 18. As shown in this embodiment, four grooves 36 are provided. Each of the grooves is $\frac{1}{8}''$ wide and 3/64″ deep. The grooves are positioned 90° apart and extend at roughly a 30° angle through the thrust flange 33.

Figure 3:
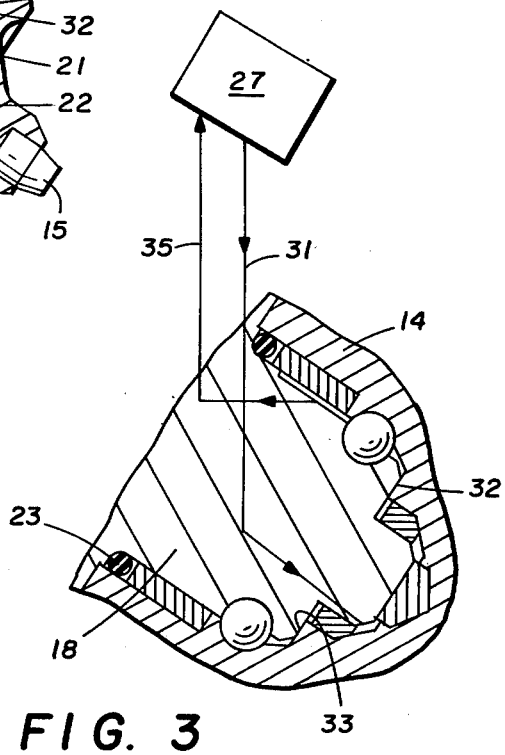
FIG. 3 is a schematic diagram of the lubricant circulation system of the present invention.

The structural details of an earth boring bit 10 constructed in accordance with the present invention having been described, the operation of the bit 10 will now be considered with reference to FIG. 3. The lubrication system of the bit 10 is filled with a suitable lubricant. The bit is rotated and thrust downward, thrusting the cutter 14 against the earth formations. Continued rotation with the drill string applying a thrust force to the bit 10 causes the cutters to disintegrate the formations and form the desired borehole. Lubricant is circulated from the lubricant reservoir 27 to the bearings of the bit and back to the lubricant reservoir 27 by the lubricant circulation system operated by rotation of the cone cutter 14 upon the bearing pin 18 of the bit. The seal 23 is located between the rolling cone cutter 14 and the bearing pin 18 of the bit to maintain lubricant in the bearing area and to prevent fluid in the borehole from entering the bearing area. The lubricant reservoir 27 is located in the bit body. The first passage 31 connects the lubricant reservoir 27 with the bearing area to channel lubricant from the lubricant reservoir 27 to the bearing area. The second passage 35 (including passage 24) extends from the bearing area to the lubricant reservoir 27 to allow lubricant to be channeled back to the lubricant reservoir. The groove system in the thrust flange 33 of the cone cutter 14 operates as a viscous or ram pump when rotating against the thrust flange 32 of the bearing pin 18 providing a pumping action to circulate lubricant from the lubricant reservoir 27 through said first passage 31 to the bearing area and from the bearing area through said second passage 35 back to said lubricant reservoir 27.

The embodiments of the invention in which an exclusive property or privilege is claimed are defined as follows:

1. An earth boring bit, comprising:

a bit body;

a bearing pin extending from said bit body;

a rotatable cutter mounted upon said bearing pin;

bearing and seal means between said bearing pin and said cutter;

a thrust flange on said bearing pin;

a thrust flange in said rotatable cutter positioned opposite said thrust flange on said bearing pin;

a lubricant reservoir in said bit body;

lubricant in said lubricant reservoir;

first passage means for channeling lubricant from said lubricant reservoir to said bearing means;

second passage means for channeling lubricant from said bearing means to said lubricant reservoir; and a series of grooves extending across said thrust flange in said rotatable cutter for pumping said lubricant through said first passage means from said lubricant reservoir to said bearing means and through second passage means from said bearing means back to said lubricant reservoir, said series of grooves in said thrust flange of said rotatable cutter acting against said thrust flange of said bearing pin to pump lubricant through said first and second passage means.

* * * * *